US011162154B2

(12) United States Patent
Lv et al.

(10) Patent No.: US 11,162,154 B2
(45) Date of Patent: Nov. 2, 2021

(54) NON-ORIENTED ELECTRICAL STEEL HAVING EXCELLENT MAGNETIC PROPERTIES

(71) Applicant: BAOSHAN IRON & STEEL CO., LTD., Shanghai (CN)

(72) Inventors: Xuejun Lv, Shanghai (CN); Feng Zhang, Shanghai (CN); Zhenyu Zong, Shanghai (CN); Yanli Song, Shanghai (CN); Lingyun Chen, Shanghai (CN); Bo Wang, Shanghai (CN); Shishu Xie, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 84 days.

(21) Appl. No.: 16/343,216

(22) PCT Filed: Oct. 26, 2017

(86) PCT No.: PCT/CN2017/107797
§ 371 (c)(1),
(2) Date: Apr. 18, 2019

(87) PCT Pub. No.: WO2018/077210
PCT Pub. Date: May 3, 2018

(65) Prior Publication Data

US 2020/0181727 A1 Jun. 11, 2020

(30) Foreign Application Priority Data

Oct. 28, 2016 (CN) ..... 201610963121.5

(51) Int. Cl.

| | |
|---|---|
| ***C21D 9/46*** | (2006.01) |
| ***C22C 38/14*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***C21D 8/12*** | (2006.01) |
| ***C21D 8/00*** | (2006.01) |
| ***C21D 6/00*** | (2006.01) |
| ***H01F 1/147*** | (2006.01) |

(52) U.S. Cl.
CPC ..... *C21D 9/46* (2013.01); *C21D 6/005* (2013.01); *C21D 6/008* (2013.01); *C21D 8/005* (2013.01); *C21D 8/1222* (2013.01); *C22C 38/001* (2013.01); *C22C 38/02* (2013.01); *C22C 38/04* (2013.01); *C22C 38/06* (2013.01); *C22C 38/14* (2013.01); *H01F 1/147* (2013.01); *C22C 2202/02* (2013.01)

(58) Field of Classification Search
CPC ..... C21D 8/12; C21D 8/1222; C21D 8/1233; C22C 38/00; C22C 38/02; C22C 38/04; C22C 38/06; C22C 38/14; H01F 1/147; H01F 1/14775
See application file for complete search history.

(56) References Cited

FOREIGN PATENT DOCUMENTS

| | | | |
|---|---|---|---|
| CN | 101306434 | | 11/2008 |
| CN | 101812629 | A * | 8/2010 |
| CN | 102796948 | | 11/2012 |
| CN | 102796948 | A * | 11/2012 |
| CN | 103614615 | | 3/2014 |
| CN | 105779876 | | 7/2016 |
| JP | H0873939 | | 3/1996 |
| WO | 2013054514 | | 4/2013 |

OTHER PUBLICATIONS

International Search Report and Written Opinion dated Feb. 1, 2018 for PCT Patent Application No. PCT/CN2017/107797.

* cited by examiner

*Primary Examiner* — Jenny R Wu
(74) *Attorney, Agent, or Firm* — Lei Fang; Smith Tempel Blaha LLC

(57) ABSTRACT

A non-oriented electrical steel having excellent magnetic properties, the chemical elements thereof in percentage by mass being: Si: 0.2-1.5%, Mn: 0.01-0.30%, Al: 0.001-0.009%, O: 0.005-0.02%, C≤0.005%, S≤0.005%, N≤0.005%, and Ti≤0.002%, the remainder being Fe and other unavoidable impurities, and Al/Si≤0.006 and Mn/Si≤0.2. The method for producing comprises the following sequence of steps: (1) smelting; (2) hot rolling: the slab heating temperature being 850° C. to 1250° C., and the final rolling temperature being 800-1050° C.; (3) acid pickling; (4) cold rolling; (5) annealing: the annealing plate temperature being controlled between 620° C.-900° C.; and (6) coating.

12 Claims, No Drawings

NON-ORIENTED ELECTRICAL STEEL HAVING EXCELLENT MAGNETIC PROPERTIES

CROSS-REFERENCE TO RELATED APPLICATIONS

This application is a 371 U.S. National Phase of PCT International Application No. PCT/CN2017/107797 filed on Oct. 26, 2017, which claims benefit and priority to Chinese patent application no. 201610963121.5, filed on Oct. 28, 2016. Both of the above-referenced applications are incorporated by reference herein in their entireties.

TECHNICAL FIELD

The present invention relates to a steel sheet and a method of manufacturing the same, and more particularly to a non-oriented electrical steel sheet and a method of manufacturing the same.

BACKGROUND ART

In recent years, as the downstream market has become more and more demanding on high efficiency, energy saving and environmental protection, the requirements for non-oriented electrical steel sheets for producing electrical machineries, compressors, and EI iron core materials are also higher. It is desirable to obtain a non-oriented electrical steel that is more excellent in magnetic properties and less expensive.

A method for improving magnetic properties commonly used in the prior art is as follows: reducing the content of harmful elements such as C, N, S, O, Ti in a non-oriented electrical steel sheet having 1.5% or less of silicon by mass to reduce the amount of tiny inclusions, thereby reducing iron loss and increasing magnetic sensation.

Another method for improving magnetic properties commonly used in the prior art is adding alloying elements to the steel to improve the magnetic properties of the finished product. For example, the amount of sulfide is controlled by adding rare earth elements to reduce the amount of harmful impurity elements. For another example, precipitation of AlN is suppressed by adding boron element to form BN. However, in the production process when boron is added, it is difficult to have a stable production. Further, in the prior art, the magnetic properties can be improved by adding the alloying elements Sn and Sb, and the recrystallization texture is improved by the segregation of the elements, thereby increasing the induction. However, the addition of Sn and Sb causes some instability of element segregation, and uneven surface segregation tends to cause the coating to fall off. Therefore, although the method for improving the magnetic properties of steel by adding alloying elements can improve the magnetic properties of the finished product, it inevitably causes an increase in manufacturing cost. In addition, the effect of the method itself for improving the magnetic properties of steel by adding alloying elements is also unstable.

For example, a Chinese patent entitled "Non-oriented electrical steel and production method thereof" (publication number: CN103882293, publication date: Jun. 25, 2014) discloses a non-oriented electrical steel. In the patent, Ce and Sn elements are compounded in a non-oriented electrical steel having a silicon content of less than 1% by mass. Therefore, when the hot-rolled sheet of the non-oriented electrical steel of the patent is not normalized, the iron loss is reduced by 0.4~0.8 w/kg, and the induction is improved by 0.01~0.02 T.

SUMMARY OF THE INVENTION

One of the objects of the present invention is to provide a non-oriented electrical steel sheet having excellent magnetic properties. By controlling the contents of Si, Mn and Al in the steel sheet, oxide inclusions of large particles and the precipitation of tiny sulfides and nitrides are reduced, and grain growth after annealing is improved, and a non-oriented electrical steel having excellent magnetic properties is obtained.

Based on the above object, the present invention provides a non-oriented electrical steel having excellent magnetic properties, comprising the following chemical elements in mass percentage:

Si: 0.2~1.5%, Mn: 0.01~0.30%, Al: 0.001~0.009%, O: 0.005~0.02%, C≤0.005%, S≤0.005%, N≤0.005%, and Ti≤0.002%, the balance being Fe and other inevitable impurities, and Al/Si≤0.006 and Mn/Si≤0.2.

The technical solutions of the invention control the amount and morphology of low-melting oxide inclusions (especially silicate-based oxide inclusions) by controlling the content ratio of Si, Al, Mn elements, thereby reducing the precipitation of tiny nitrides and sulfides. Thus, a non-oriented electrical steel sheet having excellent magnetic properties is obtained.

Further, the design principle of each chemical element in the non-oriented electrical steel sheet having excellent magnetic properties of the present invention is as follows:

Silicon: In the non-oriented electrical steel sheet having excellent magnetic properties according to the present invention, silicon is an element which effectively increases the electrical resistivity of steel. When the mass percentage of Si is less than 0.2%, the iron loss cannot be effectively reduced. However, when the mass percentage of Si is higher than 1.5%, the magnetic flux density is remarkably lowered, and the workability is deteriorated. Therefore, the mass percentage of silicon in the non-oriented electrical steel sheet having excellent magnetic properties according to the present invention is controlled to 0.2~1.5%.

Manganese: In the technical solutions of the present invention, manganese is used to increase the electrical resistivity of steel and to improve the surface state of electrical steel. Therefore, the mass percentage of manganese in the non-oriented electrical steel sheet having excellent magnetic properties according to the present invention is controlled to 0.01~0.30%.

Aluminum: Since small AlN particles inhibit the growth of grain, aluminum is one of the main harmful inclusions that degrade the magnetic properties of non-oriented silicon steels. In addition, for steels with a low mass percentage of Al, the higher the content of Als, the more the combination of Al and N elements, and the more AlN inclusions are produced, and thus the greater the damage to electromagnetic properties. Therefore, in the technical solutions of the present invention, in addition to limiting the mass percentage of Al, the Al/Si ratio is simultaneously defined to control the content of Als, thereby controlling the amount of AlN precipitated. In view of this, in the non-oriented electrical steel sheet having excellent magnetic properties according to the present invention, the mass percentage of Al is controlled to 0.001~0.009% and Al/Si is controlled to 0.006 or less.

In addition, Al is the strongest reducing agent that reduces most of free oxygen in molten steel. When the mass percentage of aluminum is low, there is always a certain amount of free oxygen in the steel, which oxidizes the weak deoxidizing elements Si and Mn in the steel. As the temperature of the molten steel gradually decreases, the concentration product of silicon/manganese and oxygen gradually becomes saturated, and a certain amount of $SiO_2$ and MnO are precipitated in the steel. Further, the higher the content of Mn, the more MnO is formed. Since the melting point of MnO is low and the initial melting temperature thereof is lower than 1000° C., MnO is easily deformed and pin the grain boundaries during the heating and the rolling of a slab, which suppresses the effect of recrystallization and the growth of grain size. Therefore, in order to control the content of MnO and the degree of deformation thereof, it is necessary to control the ratio of Mn to Si. When Mn/Si≤0.2, the content of $SiO_2$ in the oxide inclusions is high. Through the recombination and regeneration of $SiO_2$ and MnO, the melting point is increased and the degree of deformation is reduced, so that the damage of MnO to the magnetic properties of the finished product can be reduced. On the other hand, controlling of the ratio of Mn/Si is beneficial to increase the content of $SiO_2$ and the precipitation of MnS and AlN at the interface of the $SiO_2$ inclusion phase, thereby reducing the amount of MnS and AlN dispersed precipitates in the steel, which is advantageous for the increase of the crystal grains of the finished product.

Carbon: In the non-oriented electrical steel sheet of the present invention, carbon is a harmful residual element. In the technical solutions of the present invention, carbon strongly suppresses the growth of crystal grains, easily deteriorates the magnetic properties of steel, and causes severe magnetic aging. Therefore, in the non-oriented electrical steel sheet having excellent magnetic properties according to the present invention, the mass percentage of carbon is controlled to 0.005% or less.

Sulfur: In the non-oriented electrical steel sheet of the present invention, sulfur is a harmful residual element. An increase in the mass percentage of sulfur causes an increase in the amount of sulfide precipitation such as manganese sulfide, hinders grain growth and deteriorates iron loss. Therefore, in the non-oriented electrical steel sheet having excellent magnetic properties according to the present invention, the mass percentage of sulfur is controlled to 0.005% or less.

Nitrogen: In the non-oriented electrical steel sheet of the present invention, nitrogen is a harmful residual element. An increase in the mass percentage of nitrogen causes an increase in the amount of nitride precipitation such as AlN, hinders grain growth and deteriorates iron loss. Therefore, in the non-oriented electrical steel sheet having excellent magnetic properties according to the present invention, the mass percentage of nitrogen is controlled to 0.005% or less.

Titanium: In the non-oriented electrical steel sheet of the present invention, titanium is a harmful residual element. As a strong magnetic deterioration element, titanium must be strictly controlled. Therefore, in the non-oriented electrical steel sheet having excellent magnetic properties according to the present invention, the mass percentage of titanium is controlled to 0.002% or less.

Further, the non-oriented electrical steel according to the present invention has a ternary inclusion of $SiO_2$—$Al_2O_3$—MnO, wherein the volume percentage of $SiO_2$ is 95~98%, the volume percentage of $Al_2O_3$ is 2%~3%, and the volume percentage of MnO is 2% or less.

Further, in order to obtain a non-oriented electrical steel sheet having excellent magnetic properties, the content of inclusions is further defined in the technical solutions for the following reasons: silicate-based inclusions have a high ductility and a wide range of length to width ratios (the length to width ratio is generally 3 or more), and the ends of the inclusions are at an acute angle. In order to prevent the inhibiting effect on grain growth from inclusions, the volume percentage thereof is limited.

Further, in the non-oriented electrical steel according to the present invention, the grade of silicate-based oxide inclusions (i.e., C-type oxide inclusions) in the steel is 1.5 or less. A grade of silicate-based oxide inclusions of 1.5 or less is more conducive to prevent inhibiting effect on grain growth from inclusions, wherein the grade is evaluated according to GB10561-2005.

Further, in the non-oriented electrical steel according to the present invention, the grade of silicate-based oxide inclusions in the steel sheet is 1.0 or less.

Preferably, in the non-oriented electrical steel according to the present invention, the grain size is 45 μm or more.

Preferably, in the non-oriented electrical steel according to the present invention, the grain size is 50 μm or more.

Further, in the non-oriented electrical steel according to the present invention, Al/Si≤0.003. In order to further obtain a better implementation effect, the ratio of Al/Si is further defined to Al/Si≤0.003.

Further, in the non-oriented electrical steel according to the present invention, iron loss $P_{15/50}$ is 3.8 W/kg or less, and magnetic induction is 1.64 T or more.

Further, in the non-oriented electrical steel according to the present invention, iron loss $P_{15/50}$ is 3.3 W/kg or less.

Accordingly, another object of the present invention is to provide a method for manufacturing the non-oriented electrical steel having excellent magnetic properties as described above. The degree of iron loss of the non-oriented electrical steel sheet obtained by the manufacturing method is greatly improved, and the manufacturing method is simple and easy to operate, and is suitable for mass production.

Based on the above object, the present invention provides a method for manufacturing the non-oriented electrical steel sheet having excellent magnetic properties as described above, comprising the following steps in order:

(1) smelting;

(2) hot rolling: a slab heating temperature being 850° C.~1250° C., and a final rolling temperature being 800~1050° C.;

(3) acid pickling;

(4) cold rolling;

(5) annealing: a temperature during annealing is controlled to 620° C.~900° C.;

(6) coating.

In the step (2) of the manufacturing method of the present invention, the definition of the heating temperature of the slab and the control of the hot rolling finishing temperature are for reducing the tiny dispersion of AlN and MnS in the steel.

Further, in order to prevent the iron loss after the stress relief annealing from being disqualified and fluctuating, and in order to further increase the grain size after annealing, the temperature during annealing is controlled to 620~900° C.

The non-oriented electrical steel sheet according to the present invention is excellent in magnetic properties, and the iron loss of the steel sheet is greatly improved, the crystal grain size is 45 μm or more, the iron loss is 3.8 W/kg or less, and the magnetic induction is 1.64 T or more.

Moreover, the non-oriented electrical steel sheet having excellent magnetic properties according to the present invention effectively controls the amount and morphology of large particles of oxide inclusions, tiny sulfides and nitrides precipitated by controlling the ratio of chemical elements Si, Mn and Al.

In addition to the above advantages, the manufacturing method of the present invention has the advantages of low manufacturing cost and simple operation. Since the manufacturing method of the present invention does not require the addition of rare earth elements or alloying elements such as Sn, Sb, and B, the manufacturing cost is saved, the steps of the production process are reduced, and it is suitable for mass production.

DETAILED DESCRIPTION

The non-oriented electrical steel sheet and manufacturing method thereof according to the present invention will be further explained and illustrated below with reference to specific Examples. However, the explanations and illustrations do not unduly limit the technical solutions of the present invention.

Examples A1-A9 and Comparative Examples B1-B4

The steel sheets of the above Examples and Comparative Examples were prepared by the following steps:

(1) smelting: steel sheet was smelted according to Table 1;

(2) hot rolling: a slab heating temperature was 850° C.~1250° C., and the final rolling temperature was 800~1050° C.;

(3) acid pickling: before cold rolling, the steel sheet was repeatedly bent and pickled to remove the surface millscale, and after pickling, water was sprayed to remove the acid and dirt on the surface;

(4) cold rolling: the steel sheet was rolled by a continuous cold rolling mill, wherein the total rolling reduction rate is 70~85%.

(5) annealing: before annealing, the rolling oil and dirt on the surface was removed with an alkali solution of 60~90° C., and then the annealing is conducted in a continuous annealing furnace under a mixed atmosphere of $H_2$+$N_2$, wherein the sheet temperature during annealing is controlled to 620° C.~900° C.;

(6) coating: the surface of the steel sheet was coated with a chromium-containing coating or a chromium-free coating.

It should be noted that the coating is selected according to the specific conditions of each embodiment, for example, a chromium-containing coating or a chromium-free coating may be used.

Table 1 lists the mass percentage of chemical elements in Examples and Comparative Examples.

TABLE 1

(wt %, the balance is Fe and other inevitable impurity elements)

| No. | Si | Mn | Al | O | C | S | N | Ti | Al/Si | Mn/Si | Volume percentage of $SiO_2$ (%) | Volume percentage of $Al_2O_3$ (%) | Volume percentage of MnO (%) | Grade of silicate-based oxide inclusions | Grain size (μm) |
|---|---|---|---|---|---|---|---|---|---|---|---|---|---|---|---|
| A1 | 1.2 | 0.20 | 0.0025 | 0.0055 | 0.0017 | 0.0026 | 0.0009 | 0.0001 | 0.0021 | 0.168 | 95.2 | 2.9 | 1.9 | 1.0 Grade | 56 |
| A2 | 0.82 | 0.14 | 0.0021 | 0.0055 | 0.0018 | 0.0027 | 0.0010 | 0.0001 | 0.0025 | 0.169 | 97.8 | 2.1 | 0.1 | 1.0 Grade | 54 |
| A3 | 1.42 | 0.26 | 0.0061 | 0.0054 | 0.0017 | 0.0027 | 0.0009 | 0.0002 | 0.0043 | 0.18 | 96.4 | 2.9 | 0.7 | 1.0 Grade | 54 |
| A4 | 0.976 | 0.18 | 0.004 | 0.0056 | 0.0016 | 0.0029 | 0.0010 | 0.0002 | 0.0041 | 0.185 | 96.5 | 2.1 | 1.4 | 1.0 Grade | 52 |
| A5 | 0.76 | 0.13 | 0.003 | 0.0057 | 0.0018 | 0.0026 | 0.0011 | 0.0001 | 0.0039 | 0.171 | 96.1 | 2.4 | 1.5 | 1.0 Grade | 49 |
| A6 | 0.36 | 0.067 | 0.0017 | 0.0058 | 0.0017 | 0.0027 | 0.0011 | 0.0001 | 0.0048 | 0.186 | 97.4 | 2.4 | 0.2 | 1.5 Grade | 45 |
| A7 | 0.92 | 0.16 | 0.003 | 0.0055 | 0.0016 | 0.0024 | 0.0010 | 0.0001 | 0.0033 | 0.174 | 96.7 | 2.8 | 0.5 | 1.0 Grade | 46 |
| A8 | 1.3 | 0.17 | 0.004 | 0.0054 | 0.0014 | 0.0023 | 0.0007 | 0.0001 | 0.0031 | 0.13 | 95.5 | 2.8 | 1.7 | 1.0 Grade | 44 |
| A9 | 1.02 | 0.18 | 0.004 | 0.0053 | 0.0017 | 0.0025 | 0.0008 | 0.0001 | 0.0039 | 0.18 | 97.7 | 2.2 | 0.1 | 1.0 Grade | 45 |
| B1 | 1.45 | ***0.35*** | 0.001 | 0.0058 | 0.0018 | 0.0028 | 0.0011 | 0.0002 | 0.0007 | ***0.241*** | ***94.8*** | 3 | ***2.2*** | ***2.0*** Grade | ***38*** |
| B2 | 0.75 | 0.15 | ***0.03*** | 0.0056 | 0.0015 | 0.0027 | 0.0011 | 0.0001 | ***0.04*** | 0.2 | ***99.1*** | ***0.8*** | 0.1 | ***2.0*** Grade | ***35*** |
| B3 | 0.54 | ***0.35*** | 0.009 | 0.0060 | 0.0017 | 0.0030 | 0.0010 | 0.0001 | ***0.0167*** | ***0.648*** | 95.7 | ***4.1*** | 0.2 | ***2.5*** Grade | ***29*** |
| B4 | 0.54 | 0.1 | ***0.08*** | 0.0057 | 0.0016 | 0.0026 | 0.0011 | 0.0001 | ***0.1481*** | 0.185 | 95 | 2.1 | ***2.9*** | ***2.5*** Grade | ***24*** |

Note:
The grade of silicate-based oxide inclusions is evaluated according to GB10561-2005.

Table 2 lists the specific process parameters in the manufacturing method of Examples and Comparative Examples.

TABLE 2

| No. | Hot rolling slab heating temperature (° C.) | Final rolling temperature (° C.) | Reduction rate (%) | Temperature during annealing (° C.) |
|---|---|---|---|---|
| A1 | 1138 | 876 | 80.4% | 881 |
| A2 | 1132 | 872 | 81.0% | 886 |
| A3 | 1145 | 876 | 82.5% | 889 |
| A4 | 1135 | 870 | 81.0% | 880 |
| A5 | 1131 | 870 | 75.0% | 878 |
| A6 | 1128 | 865 | 83.0% | 872 |
| A7 | 1200 | 1000 | 78.0% | 720 |
| A8 | 930 | 800 | 79.0% | 900 |
| A9 | 1060 | 830 | 73.0% | 895 |
| B1 | 1142 | 870 | 81.5% | 887 |
| B2 | 1135 | 869 | 80.5% | 882 |
| B3 | 1130 | 873 | 79.5% | 879 |
| B4 | 1132 | 875 | 80.8% | 876 |

The steel sheets of the above Examples and Comparative Examples were sampled and tested for performances. The performance parameters measured by the test were listed in Table 3.

Table 3 lists the performance parameters of Examples and Comparative Examples.

TABLE 3

| No. | Magnetic induction (T) | Iron loss $P_{15/50}$ (W/kg) |
|---|---|---|
| A1 | 1.737 | 3.15 |
| A2 | 1.738 | 3.25 |
| A3 | 1.74 | 3.30 |
| A4 | 1.741 | 3.53 |
| A5 | 1.743 | 3.69 |

TABLE 3-continued

| No. | Magnetic induction (T) | Iron loss $P_{15/50}$ (W/kg) |
|---|---|---|
| A6 | 1.751 | 3.73 |
| A7 | 1.736 | 3.62 |
| A8 | 1.735 | 3.73 |
| A9 | 1.734 | 3.7 |
| B1 | 1.731 | ***4.61*** |
| B2 | 1.735 | ***4.78*** |
| B3 | 1.745 | ***5.12*** |
| B4 | 1.742 | ***5.9*** |

As can be seen from Table 3, the iron loss $P_{15/50}$ of the Examples A1-A9 of the present application is significantly lower than that of the Comparative Examples B1-B4, indicating that the magnetic properties of the Examples are better than that of the Comparative Examples.

Table 4 lists the relevant parameter criteria of the JIS standard.

TABLE 4

| Grade | Iron loss requirements in JIS standard (W/kg) | Typical iron loss of products in JIS standard (W/kg) | Typical magnetic induction of products in JIS standard (T) |
|---|---|---|---|
| 50A400 | ≤4.0 | 3.35 | 1.70 |
| 50A1000 | ≤10.0 | 5.96 | 1.75 |

As can be seen from Table 4, according to the JIS standard, Examples A1-A9 achieved the performance indexes of a non-oriented electrical steel sheet of the high grade 50A400 from the low grade 50A1000.

In combination with Tables 1 and 3, it can be seen that in Comparative Examples B1 and B3, the mass percentage of Mn is higher than 0.3% and Mn/Si>0.2, resulting in iron loss values higher than 3.8 W/kg; in Comparative Examples B2 and B4, the mass percentage of Al is higher than 0.009% and Al/Si>0.006, resulting in iron loss values higher than 3.8 W/kg. In addition, in Comparative Examples B1-B4, the grade of silicate-based oxide inclusions is too high and the grain size is small, which also lead to inferior effects compared to Examples A1-A9.

It should be noted that the above are merely illustrative of specific Examples of the invention. It is obvious that the present invention is not limited to the above Examples but has many similar variations. All modifications that are directly derived or associated by those skilled in the art are intended to be within the scope of the present invention.

The invention claimed is:

1. A non-oriented electrical steel comprising the following chemical elements in mass percentage:

Si: 1.2~1.5%, Mn: 0.20~0.30%, Al: 0.001~0.0025%, O: 0.005~0.02%, C≤0.005%, S≤0.005%, N≤0.005%, and Ti≤0.002%, the balance being Fe and other inevitable impurities; and Al/Si≤0.006 and Mn/Si≤0.2, wherein the steel has a ternary inclusion of $SiO_2$—$Al_2O_3$—MnO, wherein volume percentage of $SiO_2$ is 95~98%, volume percentage of $Al_2O_3$ is 2%~3%, and volume percentage of MnO is 2% or less.

2. The non-oriented electrical steel according to claim 1, wherein grade of silicate-based oxide inclusions in the steel is 1.5 or less.

3. The non-oriented electrical steel according to claim 2, wherein grade of silicate-based oxide inclusions in the steel is 1.0 or less.

4. The non-oriented electrical steel according to claim 1, wherein the steel has a grain size of 45 μm or more.

5. The non-oriented electrical steel according to claim 4, wherein the steel has a grain size of 50 μm or more.

6. The non-oriented electrical steel according to claim 1, wherein Al/Si is 0.003 or less.

7. The non-oriented electrical steel according to claim 1, wherein the steel has an iron loss $P_{15/50}$ of 3.8 W/kg or less, and a magnetic induction of 1.64 T or more.

8. The non-oriented electrical steel according to claim 7, wherein the iron loss $P_{15/50}$ is 3.3 W/kg or less.

9. A method for manufacturing the non-oriented electrical steel of claim 1, comprising the following steps in order:

(1) smelting;

(2) hot rolling: a slab heating temperature being 850°01250° C., and a final rolling temperature being 800-1050° C.;

(3) acid pickling;

(4) cold rolling;

(5) annealing: a temperature during annealing is controlled to 620° C.~900° C.;

(6) coating: thereby producing the non-oriented electrical steel of claim 1.

10. The method of claim 9, wherein grade of silicate-based oxide inclusions in the non-oriented electrical steel is 1.5 or less.

11. The method of claim 10, wherein the non-oriented electrical steel has a grain size of 45 μm or more.

12. The method of claim 10, the steel has an iron loss $P_{15/50}$ of 3.8 W/kg or less, and a magnetic induction of 1.64 T or more.

* * * * *